US008011450B2

(12) United States Patent
Krueger et al.

(10) Patent No.: US 8,011,450 B2
(45) **Date of Patent: *Sep. 6, 2011**

(54) ACTIVE BOTTOMHOLE PRESSURE CONTROL WITH LINER DRILLING AND COMPLETION SYSTEMS

(75) Inventors: Sven Krueger, Winsen/Aller (DE); Gerald Heisig, Braunscheweig (DE); Detlef Hahn, Hannover LS (DE); Volker Krueger, Celle (DE); Peter Aronstam, Houston, TX (US); Harald Grimmer, Lachendorf (DE); Roger Fincher, Conroe, TX (US); Larry Watkins, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 291 days.

This patent is subject to a terminal disclaimer.

(21) Appl. No.: 11/491,245

(22) Filed: Jul. 21, 2006

(65) Prior Publication Data

US 2007/0068704 A1 Mar. 29, 2007

Related U.S. Application Data

(63) Continuation-in-part of application No. 10/783,471, filed on Feb. 20, 2004, now Pat. No. 7,114,581, which is a continuation of application No. 10/251,138, filed on Sep. 20, 2002, now abandoned, said application No. 10/783,471 is a continuation-in-part of application No. 10/716,106, filed on Nov. 17, 2003, now Pat. No. 6,854,532, which is a continuation of application No. 10/094,208, filed on Mar. 8, 2002, now Pat. No. 6,648,081, which is a continuation of application No. 09/353,275, filed on Jul. 14, 1999, now Pat. No. 6,415,877.

(60) Provisional application No. 60/108,601, filed on Nov. 16, 1998, provisional application No. 60/101,541, filed on Sep. 23, 1998, provisional application No. 60/092,908, filed on Jul. 15, 1998, provisional application No. 60/095,188, filed on Aug. 3, 1998, provisional application No. 60/702,954, filed on Jul. 27, 2005, provisional application No. 60/323,803, filed on Sep. 20, 2001.

(51) Int. Cl.
*E21B 7/00* (2006.01)

(52) U.S. Cl. ..... 175/57; 175/324; 175/25; 166/380

(58) Field of Classification Search ..... 175/57, 175/324, 25; 166/380
See application file for complete search history.

(56) References Cited

U.S. PATENT DOCUMENTS 2,812,723 A 11/1957 Coberly
(Continued)

FOREIGN PATENT DOCUMENTS

EP 0290250 9/1988
(Continued)

*Primary Examiner* — William P Neuder
*Assistant Examiner* — Elizabeth C. Gottlieb
(74) *Attorney, Agent, or Firm* — Mossman, Kumar & Tyler, PC

(57) ABSTRACT

One exemplary APD Device is used with a liner drilling assembly to control wellbore pressure. The APD Device reduces a dynamic pressure loss associated with the drilling fluid returning via a wellbore annulus. Another exemplary APD Device is used to control pressure in a wellbore when deploying wellbore equipment, including running, installing and/or operating wellbore tools. The APD Device is set to reduce a dynamic pressure loss associated with a circulating fluid. The APD Device can also be configured to reduce a surge effect associated with the running of the wellbore equipment. Still another APD Device is used to control pressure in a wellbore when completing or working over a well. Exemplary completion activity can include circulating fluid other than a drilling fluid, such as a gravel slurry. The APD Device can reduce the dynamic pressure loss associated with circulation of both drilling fluid and non-drilling fluid.

19 Claims, 9 Drawing Sheets

U.S. PATENT DOCUMENTS

| | | | | | |
|---|---|---|---|---|---|
| 2,946,565 | A | * | 7/1960 | Williams | 166/264 |
| 3,595,075 | A | | 7/1971 | Dower | |
| 3,603,409 | A | | 9/1971 | Watkins | |
| 3,677,353 | A | | 7/1972 | Baker | |
| 3,815,673 | A | | 6/1974 | Bruce et al. | |
| 3,958,651 | A | | 5/1976 | Young | |
| 4,022,285 | A | | 5/1977 | Frank | |
| 4,049,066 | A | | 9/1977 | Richey | |
| 4,063,602 | A | | 12/1977 | Howell et al. | |
| 4,091,881 | A | | 5/1978 | Maus | |
| 4,099,583 | A | | 7/1978 | Maus | |
| 4,108,257 | A | | 8/1978 | Sizer | |
| 4,134,461 | A | | 1/1979 | Blomsma | |
| 4,137,975 | A | | 2/1979 | Pennock | |
| 4,149,603 | A | | 4/1979 | Arnold | |
| 4,210,208 | A | | 7/1980 | Shanks | |
| 4,223,747 | A | | 9/1980 | Marais | |
| 4,240,513 | A | | 12/1980 | Castel et al. | |
| 4,291,772 | A | | 9/1981 | Beynet | |
| 4,310,050 | A | * | 1/1982 | Bourgoyne, Jr. | 166/318 |
| 4,368,787 | A | | 1/1983 | Messenger | |
| 4,436,166 | A | | 3/1984 | Hayatdavoudi et al. | |
| 4,440,239 | A | * | 4/1984 | Evans | 175/5 |
| 4,534,426 | A | | 8/1985 | Hooper | |
| 4,613,003 | A | | 9/1986 | Ruhle | |
| 4,630,691 | A | | 12/1986 | Hooper | |
| 4,655,286 | A | * | 4/1987 | Wood | 166/285 |
| 4,744,426 | A | * | 5/1988 | Reed | 175/102 |
| 4,813,495 | A | * | 3/1989 | Leach | 175/6 |
| 5,092,406 | A | * | 3/1992 | McStravick | 166/321 |
| 5,150,757 | A | | 9/1992 | Nunley | |
| 5,168,932 | A | | 12/1992 | Worrall et al. | |
| 5,355,967 | A | | 10/1994 | Mueller et al. | |
| 5,472,057 | A | * | 12/1995 | Winfree | 175/57 |
| 5,607,018 | A | * | 3/1997 | Schuh | 166/303 |
| 5,651,420 | A | | 7/1997 | Tibbitts et al. | |
| 5,775,443 | A | | 7/1998 | Lott | |
| 6,102,138 | A | * | 8/2000 | Fincher | 175/100 |
| 6,142,236 | A | | 11/2000 | Brammer et al. | |
| 6,196,336 | B1 | * | 3/2001 | Fincher et al. | 175/101 |
| 6,216,799 | B1 | | 4/2001 | Gonalez | |
| 6,276,455 | B1 | | 8/2001 | Gonzalez | |
| 6,374,925 | B1 | | 4/2002 | Elkins et al. | |
| 6,415,877 | B1 | | 7/2002 | Fincher et al. | |
| 7,174,975 | B2 | * | 2/2007 | Krueger et al. | 175/57 |
| 2003/0146001 | A1 | | 8/2003 | Hosie et al. | |
| 2004/0206548 | A1 | | 10/2004 | Aronstam et al. | |
| 2004/0256161 | A1 | | 12/2004 | Aronstam et al. | |

FOREIGN PATENT DOCUMENTS

| | | |
|---|---|---|
| EP | 0566290 | 10/1993 |
| WO | WO0004269 | 1/2000 |
| WO | WO0050731 | 8/2000 |
| WO | WO0214649 | 2/2002 |
| WO | 03/006778 | 1/2003 |
| WO | WO03023182 | 3/2003 |

* cited by examiner

ACTIVE BOTTOMHOLE PRESSURE CONTROL WITH LINER DRILLING AND COMPLETION SYSTEMS

CROSS-REFERENCE TO RELATED APPLICATIONS

This application claims priority from U.S. Provisional Patent Application Ser. No. 60/702,954 filed Jul. 27, 2005. This application is a continuation-in-part of U.S. patent application Ser. No. 10/783,471 filed Feb. 20, 2004 now U.S. Pat. No. 7,114,581, which is: (i) a continuation of U.S. patent application Ser. No. 10/251,138 filed Sep. 20, 2002 now abandoned, which takes priority from U.S. provisional patent application Ser. No. 60/323,803 filed on Sep. 20, 2001, titled "Active Controlled Bottomhole Pressure System and Method" and (ii) a continuation-in-part of U.S. patent application Ser. No. 10/716,106 filed on Nov. 17, 2003 now U.S. Pat. No. 6,854,532, which is a continuation of U.S. patent application Ser. No. 10/094,208, filed Mar. 8, 2002, now U.S. Pat. No. 6,648,081 granted on Nov. 18, 2003, which is a continuation of U.S. application Ser. No. 09/353,275, filed Jul. 14, 1999, now U.S. Pat. No. 6,415,877, which claims benefit of U.S. Provisional Application No. 60/108,601, filed Nov. 16, 1998, U.S. Provisional Application No. 60/101,541, filed Sep. 23, 1998, U.S. Provisional Application No. 60/092,908, filed, Jul. 15, 1998 and U.S. Provisional Application No. 60/095,188, filed Aug. 3, 1998.

FIELD OF THE INVENTION

This invention relates generally to oilfield wellbore drilling systems and more particularly to systems that utilize active control of bottomhole pressure or equivalent circulating density during drilling of the wellbores.

BACKGROUND OF THE ART

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom is utilized to guide the tubing to the wellhead. The riser also serves as a conduit for fluid returning from the wellhead to the sea surface.

During drilling, the drilling operator attempts to carefully control the fluid density at the surface so as to control pressure in the wellbore, including the bottomhole pressure. Typically, the operator maintains the hydrostatic pressure of the drilling fluid in the wellbore above the formation or pore pressure to avoid well blow-out. The density of the drilling fluid and the fluid flow rate largely determine the effectiveness of the drilling fluid to carry the cuttings to the surface. One important downhole parameter controlled during drilling is the bottomhole pressure, which in turn controls the equivalent circulating density ("ECD") of the fluid at the wellbore bottom.

This term, ECD, describes the condition that exists when the drilling mud in the well is circulated. The friction pressure caused by the fluid circulating through the open hole and the casing(s) on its way back to the surface, causes an increase in the pressure profile along this path that is different from the pressure profile when the well is in a static condition (i.e., not circulating). This pressure increase is also referred to as a dynamic pressure loss. In addition to the increase in pressure while circulating, there is an additional increase in pressure while drilling due to the introduction of drill solids into the fluid. This negative effect of the increase in pressure along the annulus of the well is an increase of the pressure which can fracture the formation at the shoe of the last casing. This can reduce the amount of hole that can be drilled before having to set an additional casing. In addition, the rate of circulation that can be achieved is also limited. Also, due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on shore wellbores. This is due to the seawater gradient versus the gradient that would exist if there were soil overburden for the same depth.

In some drilling applications, it is desired to drill the wellbore at at-balance condition or at under-balanced condition. The term at-balance means that the pressure in the wellbore is maintained at or near the formation pressure. The under-balanced condition means that the wellbore pressure is below the formation pressure. These two conditions are desirable because the drilling fluid under such conditions does not penetrate into the formation, thereby leaving the formation virgin for performing formation evaluation tests and measurements. In order to be able to drill a well to a total wellbore depth at the bottomhole, ECD must be reduced or controlled. In subsea wells, one approach is to use a mud-filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling) would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riser less system wherein a centrifugal pump in a separate return line controls the fluid flow to the surface and thus the equivalent circulating density.

The present invention provides a wellbore system wherein the bottomhole pressure and hence the equivalent circulating density is controlled by creating a pressure differential at a selected location in the return fluid path with an active pressure differential device to reduce or control the bottomhole pressure. The present system is relatively easy to incorporate in new and existing systems.

SUMMARY OF THE INVENTION

The present invention provides wellbore systems for performing downhole wellbore operations for both land and offshore wellbores. Such drilling systems include a rig that moves an umbilical (e.g., drill string) into and out of the wellbore. The umbilical can include wires for transmitting power such as electrical downhole. A bottomhole assembly, carrying the drill bit, is attached to the bottom end of the drill string. A well control assembly or equipment on the well receives the bottomhole assembly and the tubing. A drilling fluid system supplies a drilling fluid into the tubing, which discharges at the drill bit and returns to the well control equipment carrying the drill cuttings via the annulus between the drill string and the wellbore. A riser dispersed between the wellhead equipment and the surface guides the drill string and provides a conduit for moving the returning fluid to the surface.

In one embodiment of the present invention, an active pressure differential device moves in the wellbore as the drill string is moved. In an alternative embodiment, the active differential pressure device is attached to the wellbore inside or wall and remains stationary relative to the wellbore during drilling. The device is operated during drilling, i.e., when the drilling fluid is circulating through the wellbore, to create a pressure differential across the device. This pressure differential alters the pressure on the wellbore below or downhole of the device. The device may be controlled to reduce the bottomhole pressure by a certain amount, to maintain the bottomhole pressure at a certain value, or within a certain range. By severing or restricting the flow through the device, the bottomhole pressure may be increased.

The system also includes downhole devices for performing a variety of functions. Exemplary downhole devices include devices that control the drilling flow rate and flow paths.

In one embodiment, sensors communicate with a controller via a communication link to maintain the wellbore pressure at a zone of interest at a selected pressure or range of pressures. The communication link can include conductors, wires, cables in or adjacent the drill string that are adapted to convey data signals and/or electrical power. The sensors are strategically positioned throughout the system to provide information or data relating to one or more selected parameters of interest such as drilling parameters, drilling assembly or BHA parameters, and formation or formation evaluation parameters. The controller for suitable for drilling operations preferably includes programs for maintaining the wellbore pressure at zone at under-balance condition, at at-balance condition or at over-balanced condition. The controller may be programmed to activate downhole devices according to programmed instructions or upon the occurrence of a particular condition.

Exemplary configurations for the APD Device and associated drive includes a moineau-type pump coupled to positive displacement motor/drive via a shaft assembly. Another exemplary configuration includes a turbine drive coupled to a centrifugal-type pump via a shaft assembly. Preferably, a high-pressure seal separates a supply fluid flowing through the motor from a return fluid flowing through the pump. In a preferred embodiment, the seal is configured to bear either or both of radial and axial (thrust) forces.

In still other configurations, a positive displacement motor can drive an intermediate device such as a hydraulic motor, which drives the APD Device. Alternatively, a jet pump can be used, which can eliminate the need for a drive/motor. Moreover, pumps incorporating one or more pistons, such as hammer pumps, may also be suitable for certain applications. In still other configurations, the APD Device can be driven by an electric motor. The electric motor can be positioned external to a drill string or formed integral with a drill string. In a preferred arrangement, varying the speed of the electrical motor directly controls the speed of the rotor in the APD device, and thus the pressure differential across the APD Device.

Bypass devices are provided to allow fluid circulation in the wellbore during tripping of the system, to control the operating set points of the APD Device and/or associated drive/motor, and to provide a discharge mechanism to relieve fluid pressure.

In another aspect, the present invention provides enhanced wellbore pressure management for drilling systems utilizing liner drilling techniques. Liner drilling systems typically include a drill string that has a liner section. As with other drilling systems, it can be advantageous to control wellbore pressure when drilling a wellbore using a liner drilling system. For instance, liner drilling systems can be used to drilling wellbores through two or more formations having different values for formation parameters other than pore or fracture pressure. In such situations, the drilling fluid weight is selected to provide a hydrostatic pressure that is at or greater than the pore pressure of an adjacent high-pressure formation. This hydrostatic pressure, however, may exceed the fracture pressure of the depleted formation. Thus, the wellbore drilled in the depleted formation can deteriorate and eventually collapse onto the drill string. As noted above, circulation of the drilling fluid creates dynamic pressure losses that further increase the pressure applied to the depleted formation, which can exacerbate deterioration and expedite wellbore collapse. Accordingly, an APD Device can be positioned in the wellbore to control pressure of the fluid in the annulus between the liner and the wellbore wall. For example, the APD Device can be positioned in a cased portion of the wellbore and configured to reduce a dynamic pressure loss associated with the circulating drilling fluid. The APD Device can reduce or eliminate the dynamic pressure loss and delay wellbore collapse. Thus, the rate of wellbore deterioration is reduced and the drill string can drill further into the wellbore before collapse.

In other embodiments, the APD Device can be used outside of the drilling context to provide wellbore pressure management during activities such as completion and workover. For instance, in one application, the APD Device can be used to control pressure in a wellbore when deploying wellbore tools and equipment. Exemplary deployments include running, installing, and/or operating wellbore equipment in the wellbore. Exemplary wellbore tools and equipment includes liners, packers, screens, liner hangers, anchors, completion equipment, fishing tools, perforating tools, whipstocks, and other tools and devices adapted to perform a selected task in a wellbore. In an exemplary application, fluid may be circulated in the wellbore while running the wellbore equipment in the wellbore. The APD Device can be set to reduce a dynamic pressure loss associated with the circulating fluid. For instance, while running liner, the APD Device can be positioned adjacent a liner hanger coupled to the liner. The pressure control provided by the APD Device can be configured to maintain wellbore pressure below a fracture pressure of a formation while running the liner. Moreover, in some embodiments, the APD Device can be configured to reduce a surge effect associated with the running of the selected wellbore equipment.

Furthermore, in addition to drilling fluids, the APD Device can be used to control pressure in a wellbore when circulating other fluids such as slurries used to gravel pack a formation, completion fluids, cement, acids, and workover fluids ("non-drilling fluids"). In certain applications, the total pressure applied by circulation of the non-drilling fluids can exceed the fracture pressure of a given formation. Advantageously, the APD Device can reduce the dynamic pressure loss component of this pressure and thereby assist in maintaining the total pressure below the formation fracture pressure.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF PREFERRED EMBODIMENTS

Figure 1A:
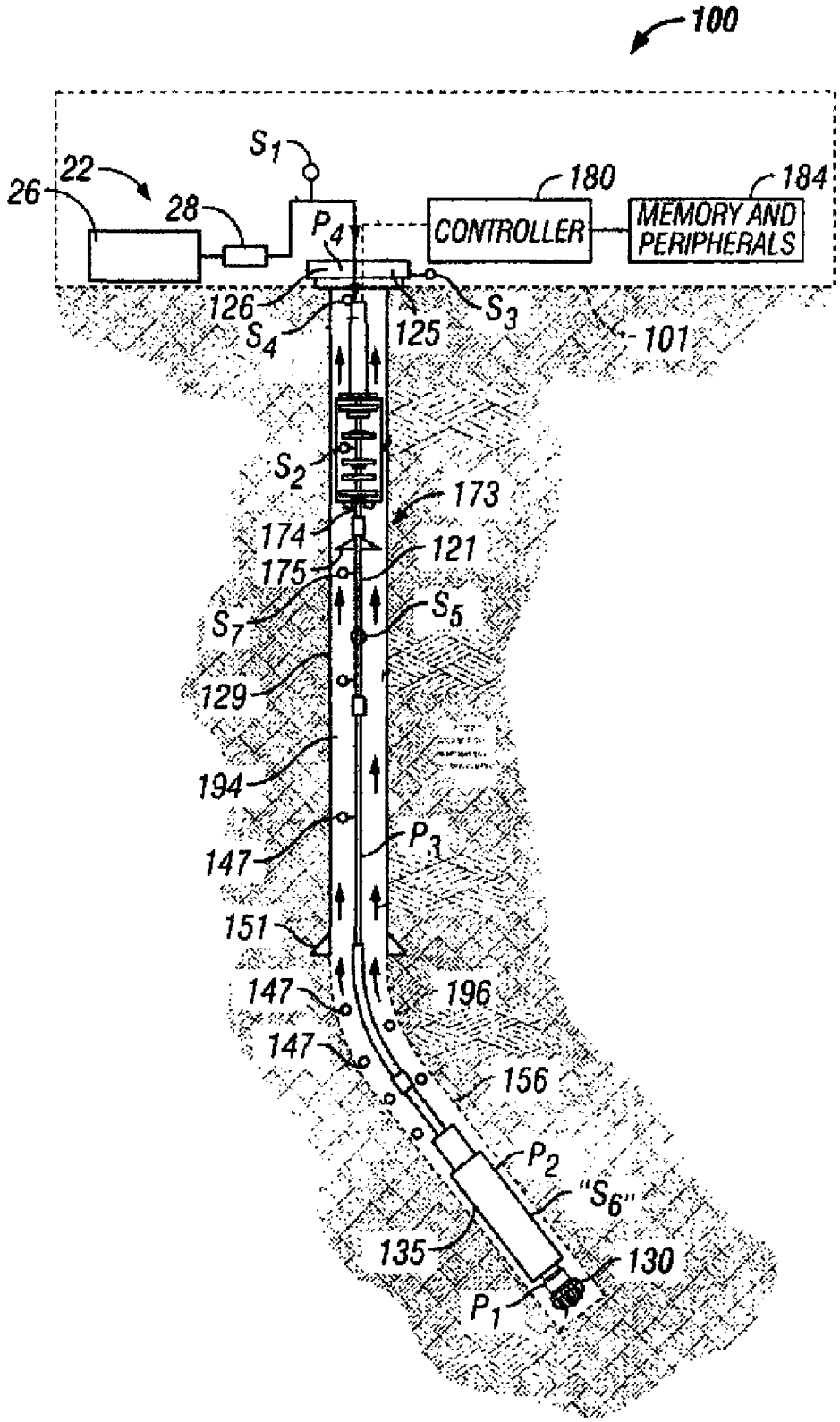
FIG. 1A is a schematic illustration of one embodiment of a system using an active pressure differential device to manage pressure in a predetermined wellbore location.

Referring initially to FIG. 1A, there is schematically illustrated a system for performing one or more operations related to the construction, logging, completion or work-over of a hydrocarbon producing well. In particular, FIG. 1A shows a schematic elevation view of one embodiment of a wellbore drilling system 100 for drilling wellbore 90 using conventional drilling fluid circulation. The drilling system 100 is a rig for land wells and includes a drilling platform 101, which may be a drill ship or another suitable surface workstation such as a floating platform or a semi-submersible for offshore wells. For offshore operations, additional known equipment such as a riser and subsea wellhead will typically be used. To drill a wellbore 90, well control equipment 125 (also referred to as the wellhead equipment) is placed above the wellbore 90. The wellhead equipment 125 includes a blow-out-preventer stack 126 and a lubricator (not shown) with its associated flow control.

This system 100 further includes a well tool such as a drilling assembly or a bottomhole assembly ("BHA") 135 at the bottom of a suitable umbilical such as drill string or tubing 121 (such terms will be used interchangeably). In a preferred embodiment, the BHA 135 includes a drill bit 130 adapted to disintegrate rock and earth. The bit can be rotated by a surface rotary drive or a motor using pressurized fluid (e.g., mud motor) or an electrically driven motor. The tubing 121 can be formed partially or fully of drill pipe, metal or composite coiled tubing, liner, casing or other known members. Additionally, the tubing 121 can include data and power transmission carriers such fluid conduits, fiber optics, and metal conductors. Conventionally, the tubing 121 is placed at the drilling platform 101. To drill the wellbore 90, the BHA 135 is conveyed from the drilling platform 101 to the wellhead equipment 125 and then inserted into the wellbore 90. The tubing 121 is moved into and out of the wellbore 90 by a suitable tubing injection system.

During drilling, a drilling fluid from a surface mud system 22 is pumped under pressure down the tubing 121 (a "supply fluid"). The mud system 22 includes a mud pit or supply source 26 and one or more pumps 28. In one embodiment, the supply fluid operates a mud motor in the BHA 135, which in turn rotates the drill bit 130. The drill string 121 rotation can also be used to rotate the drill bit 130, either in conjunction with or separately from the mud motor. The drill bit 130 disintegrates the formation (rock) into cuttings 147. The drilling fluid leaving the drill bit travels uphole through the annulus 194 between the drill string 121 and the wellbore wall or inside 196, carrying the drill cuttings 147 therewith (a "return fluid"). The return fluid discharges into a separator (not shown) that separates the cuttings 147 and other solids from the return fluid and discharges the clean fluid back into the mud pit 26. As shown in FIG. 1A, the clean mud is pumped through the tubing 121 while the mud with cuttings 147 returns to the surface via the annulus 194 up to the wellhead equipment 125.

Once the well 90 has been drilled to a certain depth, casing 129 with a casing shoe 151 at the bottom is installed. The drilling is then continued to drill the well to a desired depth that will include one or more production sections, such as section 155. The section below the casing shoe 151 may not be cased until it is desired to complete the well, which leaves the bottom section of the well as an open hole, as shown by numeral 156.

As noted above, the present invention provides a drilling system for controlling bottomhole pressure at a zone of interest designated by the numeral 155 and thereby the ECD effect on the wellbore. In one embodiment of the present invention, to manage or control the pressure at the zone 155, an active pressure differential device ("APD Device") 170 is fluidicly coupled to return fluid downstream of the zone of interest 155. The active pressure differential device is a device that is capable of creating a pressure differential "ΔP" across the device. This controlled pressure drop reduces the pressure upstream of the APD Device 170 and particularly in zone 155.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the drill string and/or the annulus 194. FIG. 1A shows an exemplary flow-control device 173 that includes a device 174 that can block the fluid flow within the drill string 121 and a device 175 that blocks can block fluid flow through the annulus 194. The device 173 can be activated when a particular condition occurs to insulate the well above and below the flow-control device 173. For example, the flow-control device 173 may be activated to block fluid flow communication when drilling fluid circulation is stopped so as to isolate the sections above and below the device 173, thereby maintaining the wellbore below the device 173 at or substantially at the pressure condition prior to the stopping of the fluid circulation.

The flow-control devices 174, 175 can also be configured to selectively control the flow path of the drilling fluid. For example, the flow-control device 174 in the drill pipe 121 can be configured to direct some or all of the fluid in drill string 121 into the annulus 194. Moreover, one or both of the flow-control devices 174, 175 can be configured to bypass some or all of the return fluid around the APD device 170. Such an arrangement may be useful, for instance, to assist in lifting cuttings to the surface. The flow-control device 173 may include check-valves, packers and any other suitable device. Such devices may automatically activate upon the occurrence of a particular event or condition.

The system 100 also includes downhole devices for processing the cuttings (e.g., reduction of cutting size) and other debris flowing in the annulus 194. For example, a comminution device 176 can be disposed in the annulus 194 upstream of the APD device 170 to reduce the size of entrained cutting and other debris. The comminution device 176 can use known members such as blades, teeth, or rollers to crush, pulverize or otherwise disintegrate cuttings and debris entrained in the fluid flowing in the annulus 194. The comminution device 176 can be operated by an electric motor, a hydraulic motor, by rotation of drill string or other suitable means. The comminution device 176 can also be integrated into the APD device 170. For instance, if a multi-stage turbine is used as the APD device 170, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In a preferred embodiment, the downhole devices and sensors $S_{1-n}$ communicate with a controller 180 via a telemetry system (not shown). Using data provided by the sensors $S_{1-n}$, the controller 180 maintains the wellbore pressure at zone 155 at a selected pressure or range of pressures. The controller 180 maintains the selected pressure by controlling the APD device 170 (e.g., adjusting amount of energy added to the return fluid line) and/or the downhole devices (e.g., adjusting flow rate through a restriction such as a valve).

When configured for drilling operations, the sensors $S_{1-n}$ provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One preferred type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the APD device 170 (S2), at the wellhead equipment 125 (S3), in the supply fluid (S4), along the tubing 121 (S5), at the well tool 135 (S6), in the return fluid upstream of the APD device 170 (S7), and in the return fluid downstream of the APD device 170 (S8). It should be understood that other locations may also be used for the sensors $S_{1-n}$.

The controller 180 for suitable for drilling operations preferably includes programs for maintaining the wellbore pressure at zone 155 at under-balance condition, at at-balance condition or at over-balanced condition. The controller 180 includes one or more processors that process signals from the various sensors in the drilling assembly and also controls their operation. The data provided by these sensors $S_{1-n}$ and control signals transmitted by the controller 180 to control downhole devices such as devices 173-176 are communicated by a suitable two-way telemetry system (not shown). A separate processor may be used for each sensor or device. Each sensor may also have additional circuitry for its unique operations. The controller 180, which may be either downhole or at the surface, is used herein in the generic sense for simplicity and ease of understanding and not as a limitation because the use and operation of such controllers is known in the art. The controller 180 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 173-175 and the surface equipment via the two-way telemetry. In other embodiments, the controller 180 can be a hydro-mechanical device that incorporates known mechanisms (valves, biased members, linkages cooperating to actuate tools under, for example, preset conditions).

For convenience, a single controller 180 is shown. It should be understood, however, that a plurality of controllers 180 can also be used. For example, a downhole controller can be used to collect, process and transmit data to a surface controller, which further processes the data and transmits appropriate control signals downhole. Other variations for dividing data processing tasks and generating control signals can also be used.

In general, however, during operation, the controller 180 receives the information regarding a parameter of interest and adjusts one or more downhole devices and/or APD device 170 to provide the desired pressure or range or pressure in the vicinity of the zone of interest 155. For example, the controller 180 can receive pressure information from one or more of the sensors ($S_1$-$S_n$) in the system 100. The controller 180 may control the APD Device 170 in response to one or more of: pressure, fluid flow, a formation characteristic, a wellbore characteristic and a fluid characteristic, a surface measured parameter or a parameter measured in the drill string. The controller 180 determines the ECD and adjusts the energy input to the APD device 170 to maintain the ECD at a desired or predetermined value or within a desired or predetermined range. The wellbore system 100 thus provides a closed loop system for controlling the ECD in response to one or more parameters of interest during drilling of a wellbore. This system is relatively simple and efficient and can be incorporated into new or existing drilling systems and readily adapted to support other well construction, completion, and workover activities.

In the embodiment shown in FIG. 1A, the APD Device 170 is shown as a turbine attached to the drill string 121 that operates within the annulus 194. Other embodiments, described in further detail below can include centrifugal pumps, positive displacement pump, jet pumps and other like devices. During drilling, the APD Device 170 moves in the wellbore 90 along with the drill string 121. The return fluid can flow through the APD Device 170 whether or not the turbine is operating. However, the APD Device 170, when operated creates a differential pressure thereacross.

As described above, the system 100 in one embodiment includes a controller 180 that includes a memory and peripherals 184 for controlling the operation of the APD Device 170, the devices 173-176, and/or the bottomhole assembly 135. In FIG. 1A, the controller 180 is shown placed at the surface. It, however, may be located adjacent the APD Device 170, in the BHA 135 or at any other suitable location. The controller 180 controls the APD Device to create a desired amount of $\Delta P$ across the device, which alters the bottomhole pressure accordingly. Alternatively, the controller 180 may be programmed to activate the flow-control device 173 (or other downhole devices) according to programmed instructions or upon the occurrence of a particular condition. Thus, the controller 180 can control the APD Device in response to sensor data regarding a parameter of interest, according to programmed instructions provided to said APD Device, or in response to instructions provided to said APD Device from a remote location. The controller 180 can, thus, operate autonomously or interactively.

During drilling, the controller 180 controls the operation of the APD Device to create a certain pressure differential across the device so as to alter the pressure on the formation or the bottomhole pressure. The controller 180 may be programmed to maintain the wellbore pressure at a value or range of values that provide an under-balance condition, an at-balance condition or an over-balanced condition. In one embodiment, the differential pressure may be altered by altering the speed of the APD Device. For instance, the bottomhole pressure may be maintained at a preselected value or within a selected range relative to a parameter of interest such as the formation pressure. The controller 180 may receive signals from one or more sensors in the system 100 and in response thereto control the operation of the APD Device to create the desired pressure differential. The controller 180 may contain pre-programmed instructions and autonomously control the APD Device or respond to signals received from another device that may be remotely located from the APD Device.

Figure 1B:
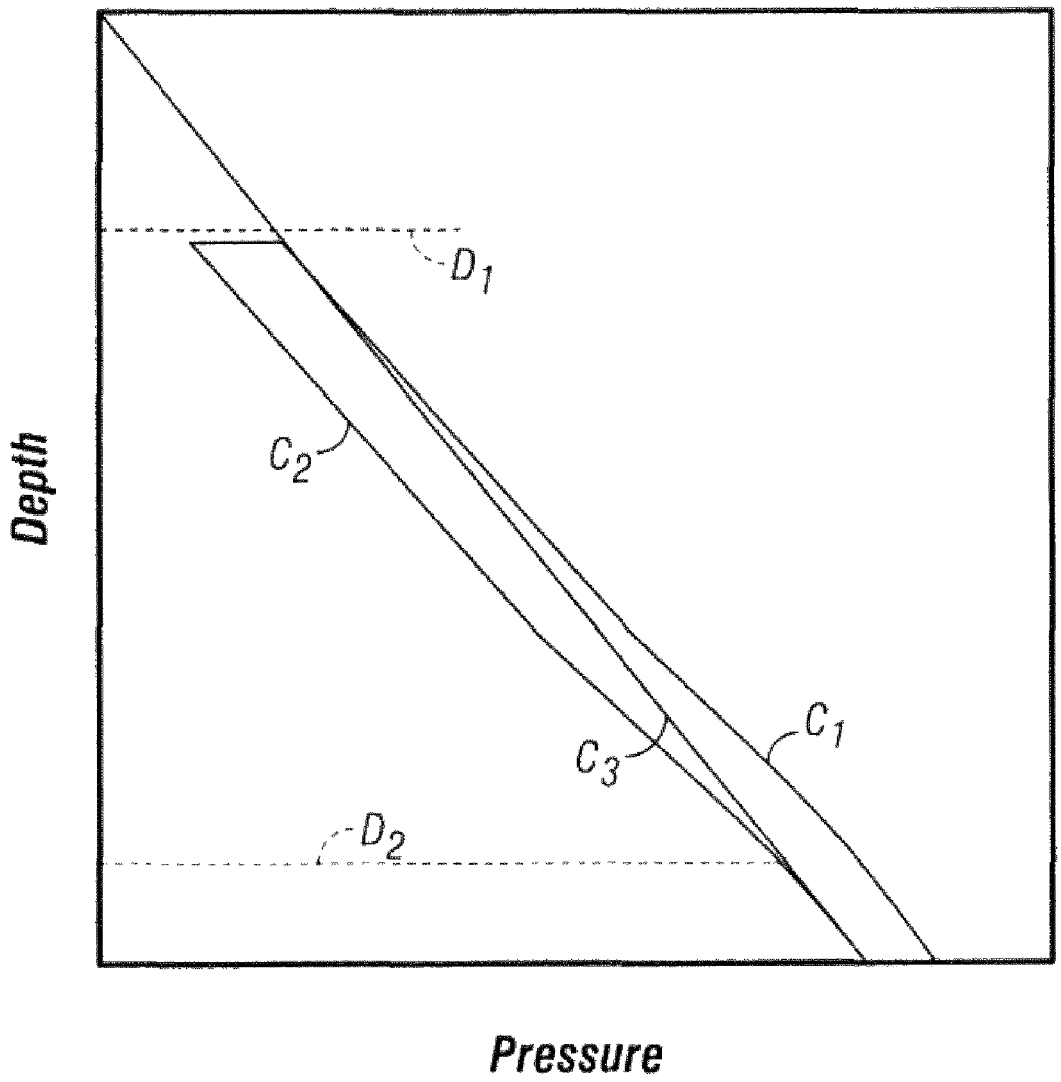
FIG. 1B graphically illustrates the effect of an operating active pressure differential device upon the pressure at a predetermined wellbore location.

FIG. 1B graphically illustrates the ECD control provided by the above-described embodiment of the present invention and references FIG. 1A for convenience. FIG. 1A shows the APD device 170 at a depth D1 and a representative location in the wellbore in the vicinity of the well tool 30 at a lower depth D2. FIG. 1B provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1 and thus shifts the pressure gradient as shown by curve C3, which can provide the desired predetermined pressure at depth D2. In most instances, this shift is roughly the pressure drop provided by the APD device 170.

Figure 2:
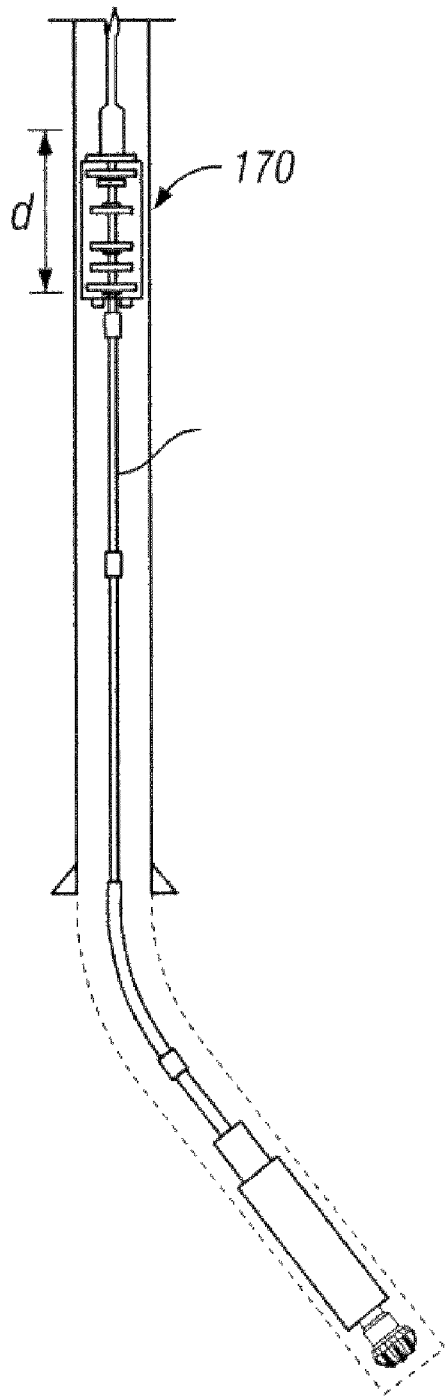
FIG. 2 is a schematic elevation view of FIG. 1A after the drill string and the active pressure differential device have moved a certain distance in the earth formation from the location shown in FIG. 1A.

FIG. 2 shows the drill string after it has moved the distance "d" shown by $t_1$-$t_2$. Since the APD Device 170 is attached to the drill string 121, the APD Device 170 also is shown moved by the distance d.

Figure 3:
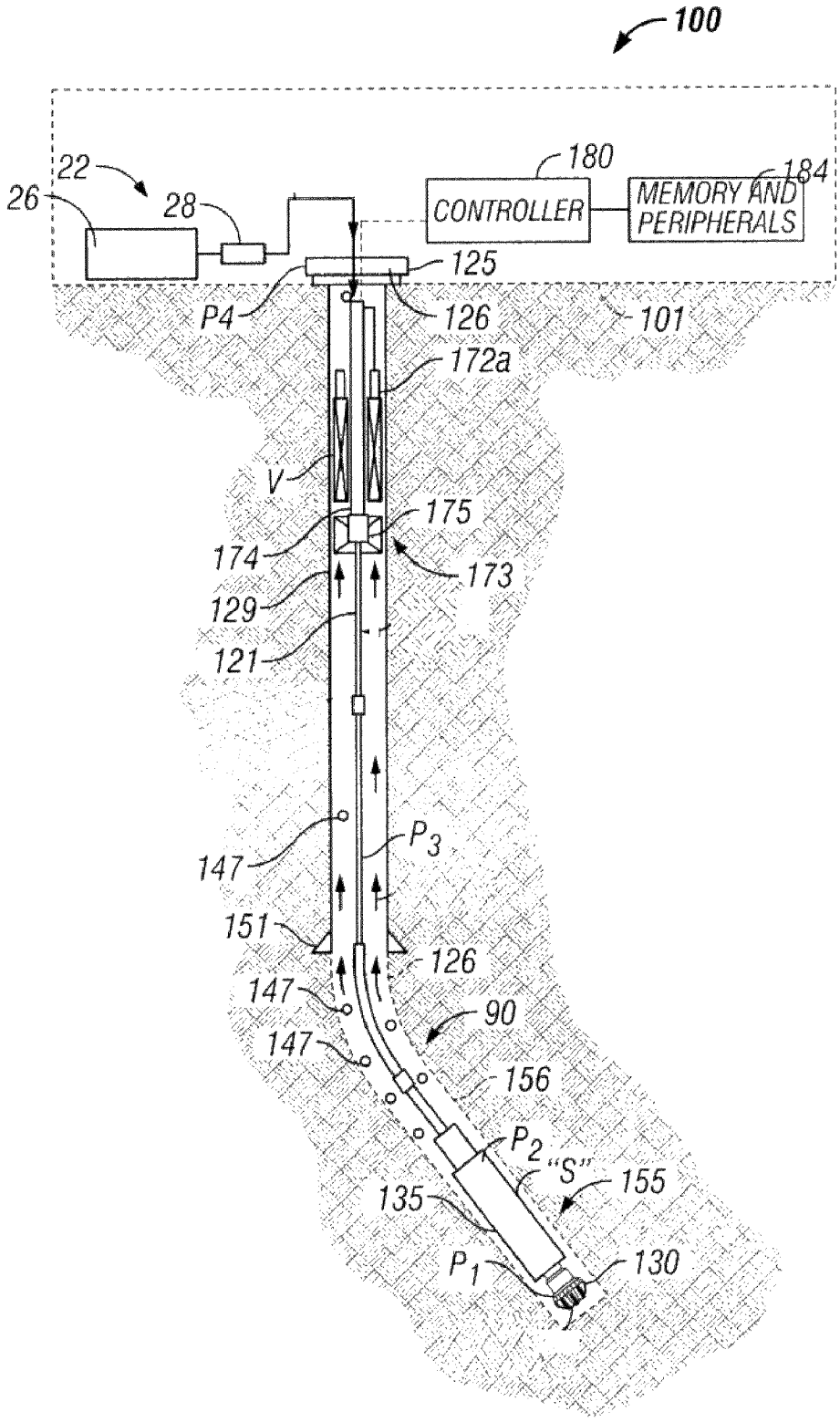
FIG. 3 is a schematic elevation view of an alternative embodiment of the wellbore system wherein the active pressure differential device is attached to the wellbore inside.
Figure 4A:
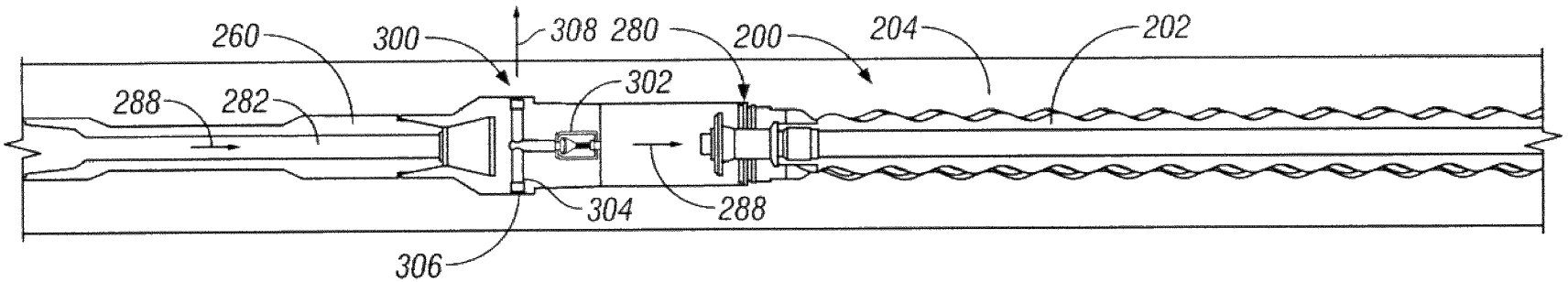
FIGS. 4A-D are schematic illustrations of one embodiment of an arrangement according to the present invention wherein a positive displacement motor is coupled to a positive displacement pump (the APD Device)
Figure 4B:
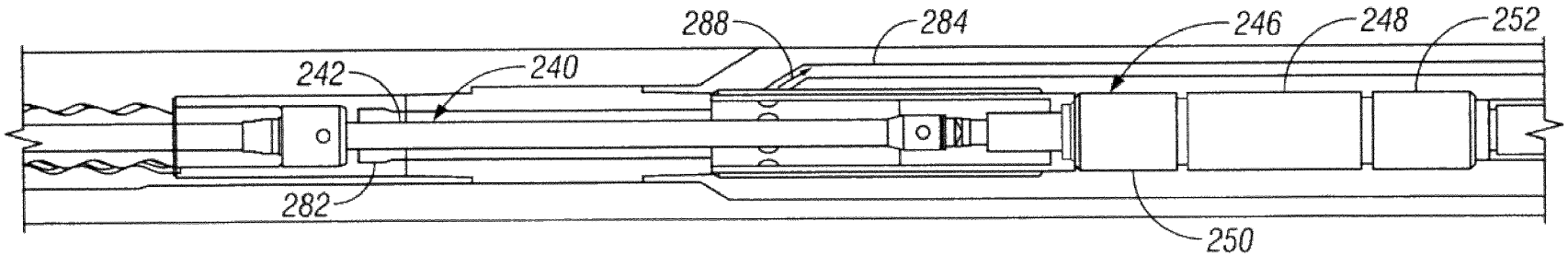
Figure 4C:
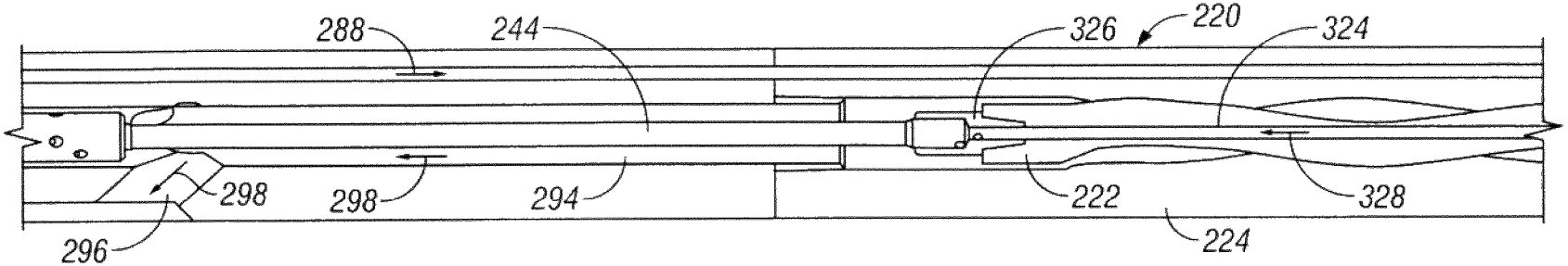
Figure 4D:
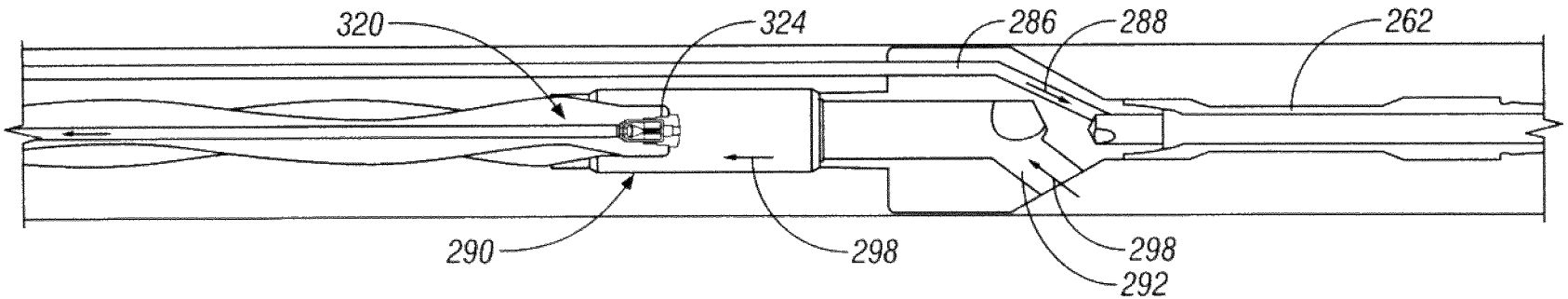

As noted earlier and shown in FIG. 2, an APD Device 170*a* may be attached to the wellbore in a manner that will allow the drill string 121 to move while the APD Device 170*a* remains at a fixed location. FIG. 3 shows an embodiment wherein the APD Device is attached to the wellbore inside and is operated by a suitable device 172*a*. Thus, the APD device can be attached to a location stationary relative to said drill string such as a casing, a liner, the wellbore annulus, a riser, or other suitable wellbore equipment. The APD Device 170*a* is preferably installed so that it is in a cased upper section 129. The device 170*a* is controlled in the manner described with respect to the device 170 (FIG. 1A).

Referring now to FIGS. 4A-D, there is schematically illustrated one arrangement wherein a positive displacement motor/drive 200 is coupled to a moineau-type pump 220 via a shaft assembly 240. The motor 200 is connected to an upper string section 260 through which drilling fluid is pumped from a surface location. The pump 220 is connected to a lower drill string section 262 on which the bottomhole assembly (not shown) is attached at an end thereof. The motor 200 includes a rotor 202 and a stator 204. Similarly, the pump 220 includes a rotor 222 and a stator 224. The design of moineau-type pumps and motors are known to one skilled in the art and will not be discussed in further detail.

The shaft assembly 240 transmits the power generated by the motor 200 to the pump 220. One preferred shaft assembly 240 includes a motor flex shaft 242 connected to the motor rotor 202, a pump flex shaft 244 connected to the pump rotor 224, and a coupling shaft 246 for joining the first and second shafts 242 and 244. In one arrangement, a high-pressure seal 248 is disposed about the coupling shaft 246. As is known, the rotors for moineau-type motors/pump are subject to eccentric motion during rotation. Accordingly, the coupling shaft 246 is preferably articulated or formed sufficiently flexible to absorb this eccentric motion. Alternately or in combination, the shafts 242, 244 can be configured to flex to accommodate eccentric motion. Radial and axial forces can be borne by bearings 250 positioned along the shaft assembly 240. In a preferred embodiment, the seal 248 is configured to bear either or both of radial and axial (thrust) forces. In certain arrangements, a speed or torque converter 252 can be used to convert speed/torque of the motor 200 to a second speed/torque for the pump 220. By speed/torque converter it is meant known devices such as variable or fixed ratio mechanical gearboxes, hydrostatic torque converters, and a hydrodynamic converters. It should be understood that any number of arrangements and devices can be used to transfer power, speed, or torque from the motor 200 to the pump 220. For example, the shaft assembly 240 can utilize a single shaft instead of multiple shafts.

As described earlier, a comminution device can be used to process entrained cutting in the return fluid before it enters the pump 200. Such a comminution device (FIG. 1A) can be coupled to the drive 200 or pump 220 and operated thereby. For instance, one such comminution device or cutting mill 270 can include a shaft 272 coupled to the pump rotor 224. The shaft 272 can include a conical head or hammer element 274 mounted thereon. During rotation, the eccentric motion of the pump rotor 224 will cause a corresponding radial motion of the shaft head 274. This radial motion can be used to resize the cuttings between the rotor and a comminution device housing 276.

The FIGS. 4A-D arrangement also includes a supply flow path 290 to carry supply fluid from the device 200 to the lower drill string section 262 and a return flow path 292 to channel return fluid from the casing interior or annulus into and out of the pump 220. The high pressure seal 248 is interposed between the flow paths 290 and 292 to prevent fluid leaks, particularly from the high pressure fluid in the supply flow path 290 into the return flow path 292. The seal 248 can be a high-pressure seal, a hydrodynamic seal or other suitable seal and formed of rubber, an elastomer, metal or composite.

Additionally, bypass devices are provided to allow fluid circulation during tripping of the downhole devices of the system 100 (FIG. 1A), to control the operating set points of the motor 200 and pump 220, and to provide safety pressure relief along either or both of the supply flow path 290 and the return flow path 292. Exemplary bypass devices include a circulation bypass 300, motor bypass 310, and a pump bypass 320.

The circulation bypass 300 selectively diverts supply fluid into the annulus 194 (FIG. 1A) or casing C interior. The circulation bypass 300 is interposed generally between the upper drill string section 260 and the motor 200. One preferred circulation bypass 300 includes a biased valve member 302 that opens when the flow-rate drops below a predetermined valve. When the valve 302 is open, the supply fluid flows along a channel 304 and exits at ports 306. More generally, the circulation bypass can be configured to actuate upon receiving an actuating signal and/or detecting a predetermined value or range of values relating to a parameter of interest (e.g., flow rate or pressure of supply fluid or operating parameter of the bottomhole assembly). The circulation bypass 300 can be used to facilitate drilling operations and to selective increase the pressure/flow rate of the return fluid.

The motor bypass 310 selectively channels conveys fluid around the motor 200. The motor bypass 310 includes a valve 312 and a passage 314 formed through the motor rotor 202. A joint 316 connecting the motor rotor 202 to the first shaft 242 includes suitable passages (not shown) that allow the supply fluid to exit the rotor passage 314 and enter the supply flow path 290. Likewise, a pump bypass 320 selectively conveys fluid around the pump 220. The pump bypass includes a valve and a passage formed through the pump rotor 222 or housing. The pump bypass 320 can also be configured to function as a particle bypass line for the APD device. For example, the pump bypass can be adapted with known elements such as screens or filters to selectively convey cuttings or particles entrained in the return fluid that are greater than a predetermined size around the APD device. Alternatively, a separate particle bypass can be used in addition to the pump bypass for such a function. Alternately, a valve (not shown) in a pump housing 225 can divert fluid to a conduit parallel to the pump 220. Such a valve can be configured to open when the flow rate drops below a predetermined value. Further, the bypass device can be a design internal leakage in the pump. That is, the operating point of the pump 220 can be controlled by providing a preset or variable amount of fluid leakage in the pump 220. Additionally, pressure valves can be positioned in the pump 220 to discharge fluid in the event an overpressure condition or other predetermined condition is detected.

Additionally, an annular seal 299 in certain embodiments can be disposed around the APD device to direct the return fluid to flow into the pump 220 (or more generally, the APD device) and to allow a pressure differential across the pump 220. The seal 299 can be a solid or pliant ring member, an expandable packer type element that expands/contracts upon receiving a command signal, or other member that substantially prevents the return fluid from flowing between the pump 220 (or more generally, the APD device) and the casing or wellbore wall. In certain applications, the clearance between the APD device and adjacent wall (either casing or wellbore) may be sufficiently small as to not require an annular seal.

During operation, the motor 200 and pump 220 are positioned in a well bore location such as in a casing C. Drilling fluid (the supply fluid) flowing through the upper drill string section 260 enters the motor 200 and causes the rotor 202 to rotate. This rotation is transferred to the pump rotor 222 by the shaft assembly 240. As is known, the respective lobe profiles, size and configuration of the motor 200 and the pump 220 can be varied to provide a selected speed or torque curve at given flow-rates. Upon exiting the motor 200, the supply fluid flows through the supply flow path 290 to the lower drill string section 262, and ultimately the bottomhole assembly (not shown). The return fluid flows up through the wellbore annulus (not shown) and casing C and enters the cutting mill 270 via a inlet 293 for the return flow path 292. The flow goes through the cutting mill 270 and enters the pump 220. In this embodiment, the controller 180 (FIG. 1A) can be programmed to control the speed of the motor 200 and thus the operation of the pump 220 (the APD Device in this instance).

It should be understood that the above-described arrangement is merely one exemplary use of positive displacement motors and pumps. For example, while the positive displacement motor and pump are shown in structurally in series in FIGS. 4A-D, a suitable arrangement can also have a positive displacement motor and pump in parallel. For example, the motor can be concentrically disposed in a pump.

Figure 5A:
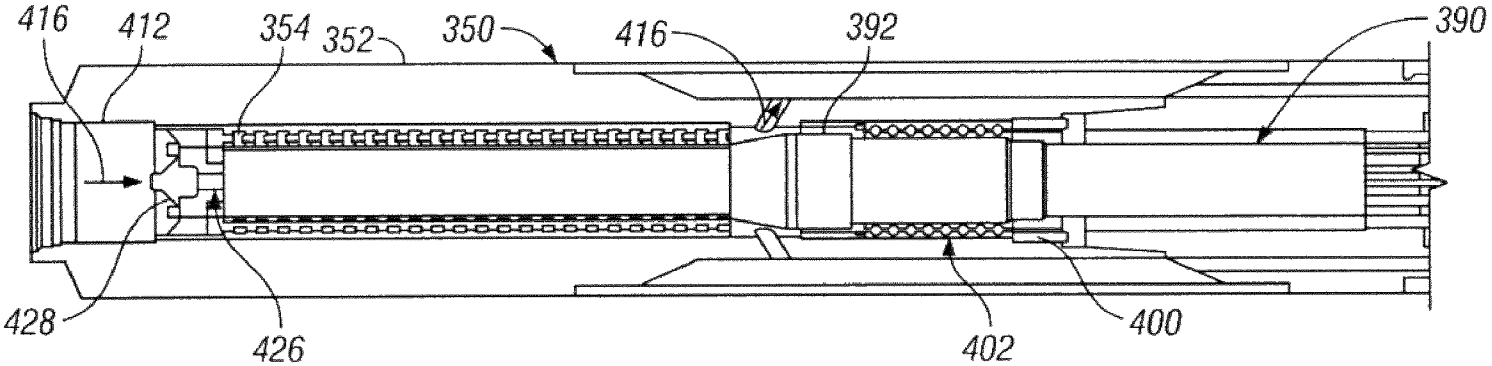
FIGS. 5A and 5B are schematic illustrations of one embodiment of an arrangement according to the present invention wherein a turbine drive is coupled to a centrifugal pump (the APD Device)
Figure 5B:
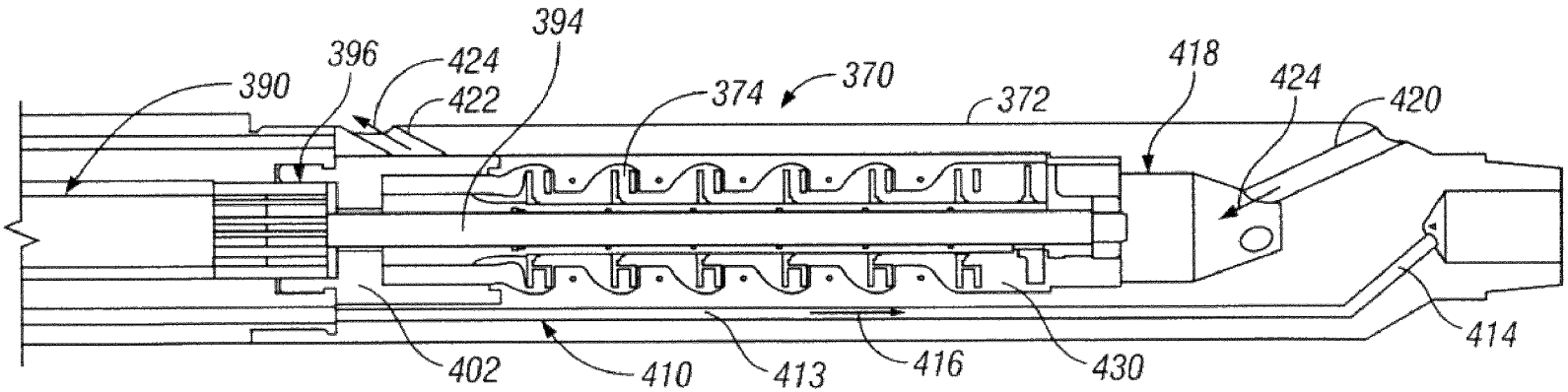

Referring now to FIGS. 5A-B, there is schematically illustrated one arrangement wherein a turbine drive 350 is coupled to a centrifugal-type pump 370 via a shaft assembly 390. The turbine 350 includes stationary and rotating blades 354 and radial bearings 402. The centrifugal-type pump 370 includes a housing 372 and multiple impeller stages 374. The design of turbines and centrifugal pumps are known to one skilled in the art and will not be discussed in further detail.

The shaft assembly 390 transmits the power generated by the turbine 350 to the centrifugal pump 370. One preferred shaft assembly 350 includes a turbine shaft 392 connected to the turbine blade assembly 354, a pump shaft 394 connected to the pump impeller stages 374, and a coupling 396 for joining the turbine and pump shafts 392 and 394.

The FIG. 5A-B arrangement also includes a supply flow path 410 for channeling supply fluid shown by arrows designated 416 and a return flow path 418 to channel return fluid shown by arrows designated 424. The supply flow path 410 includes an inlet 412 directing supply fluid into the turbine 350 and an axial passage 413 that conveys the supply fluid exiting the turbine 350 to an outlet 414. The return flow path 418 includes an inlet 420 that directs return fluid into the centrifugal pump 370 and an outlet 422 that channels the return fluid into the casing C interior or wellbore annulus. A high pressure seal 400 is interposed between the flow paths 410 and 418 to reduce fluid leaks, particularly from the high pressure fluid in the supply flow path 410 into the return flow path 418. A small leakage rate is desired to cool and lubricate the axial and radial bearings. Additionally, a bypass 426 can be provided to divert supply fluid from the turbine 350. Moreover, radial and axial forces can be borne by bearing assemblies 402 positioned along the shaft assembly 390. Preferably a comminution device 373 is provided to reduce particle size entering the centrifugal pump 370. In a preferred embodiment, one of the impeller stages is modified with shearing blades or elements that shear entrained particles to reduce their size. In certain arrangements, a speed or torque converter 406 can be used to convert a first speed/torque of the motor 350 to a second speed/torque for the centrifugal pump 370. It should be understood that any number of arrangements and devices can be used to transfer power, speed, or torque from the turbine 350 to the pump 370. For example, the shaft assembly 390 can utilize a single shaft instead of multiple shafts.

It should be appreciated that a positive displacement pump need not be matched with only a positive displacement motor, or a centrifugal pump with only a turbine. In certain applications, operational speed or space considerations may lend itself to an arrangement wherein a positive displacement drive can effectively energize a centrifugal pump or a turbine drive energize a positive displacement pump. It should also be appreciated that the present invention is not limited to the above-described arrangements. For example, a positive displacement motor can drive an intermediate device such as an electric motor or hydraulic motor provided with an encapsulated clean hydraulic reservoir. In such an arrangement, the hydraulic motor (or produced electric power) drives the pump. These arrangements can eliminate the leak paths between the high-pressure supply fluid and the return fluid and therefore eliminates the need for high-pressure seals. Alternatively, a jet pump can be used. In an exemplary arrangement, the supply fluid is divided into two streams. The first stream is directed to the BHA. The second stream is accelerated by a nozzle and discharged with high velocity into the annulus, thereby effecting a reduction in annular pressure. Pumps incorporating one or more pistons, such as hammer pumps, may also be suitable for certain applications.

In other embodiments, an electrical motor can be used to drive and control the APD Device. Varying the speed of the electrical motor will directly control the speed of the rotor in the APD device, and thus the pressure differential across the APD Device.

It will be appreciated that many variations to the above-described embodiments are possible. For example, a clutch element can be added to the shaft assembly connecting the drive to the pump to selectively couple and uncouple the drive and pump. Further, in certain applications, it may be advantages to utilize a non-mechanical connection between the drive and the pump. For instance, a magnetic clutch can be used to engage the drive and the pump. In such an arrangement, the supply fluid and drive the return fluid and pump can remain separated. The speed/torque can be transferred by a magnetic connection that couples the drive and pump elements, which are separated by a tubular element (e.g., drill string). Additionally, while certain elements have been discussed with respect to one or more particular embodiments, it should be understood that the present invention is not limited to any such particular combinations. For example, elements such as shaft assemblies, bypasses, comminution devices and annular seals discussed in the context of positive displacement drives can be readily used with electric drive arrangements. Other embodiments within the scope of the present invention that are not shown include a centrifugal pump that is attached to the drill string. The pump can include a multi-stage impeller and can be driven by a hydraulic power unit, such as a motor. This motor may be operated by the drilling fluid or by any other suitable manner. Still another embodiment not shown includes an APD Device that is fixed to the drill string, which is operated by the drill string rotation. In this embodiment, a number of impellers are attached to the drill string. The rotation of the drill string rotates the impeller that creates a differential pressure across the device.

Additionally, in certain instances, well operators encounter a situation where a well plan requires drilling a wellbore across two or more formations having a different values for one or more geophysical, geological, or petrophysical parameters and the change would negatively affect an aspect of the drilling process such as efficiency, safety, cost-effectiveness, quality, etc. Exemplary but not exclusive parameters include pore pressure and fracture pressure. Thus, for instance, the wellbore could be drilled from a high pressure formation into a formation with a significantly lower pressure, or vice versa. Because a drilling fluid of a specified weight bears on both formations at the same time, the difference in pore and fracture pressure between adjacent formations can create difficulties. For example, a relatively high mud weight may be used to ensure an overbalanced condition in the high-pressure formation to prevent a kick. The relatively high pressure associated with this drilling fluid may exceed the fracture pressure of the low-pressure formation. If the overbalance is severe, the drilling fluid flows into or "invades" the low-pressure formation, which results in the loss of drilling fluid and reduces pressure in the high-pressure formation. Moreover, a severe overbalance could lead to hole collapse. Conventionally, it is presumed that hole collapse will occur and the wellbore is drilled into the low-pressure formation until the wellbore collapses around the drilling assembly.

Figure 6:
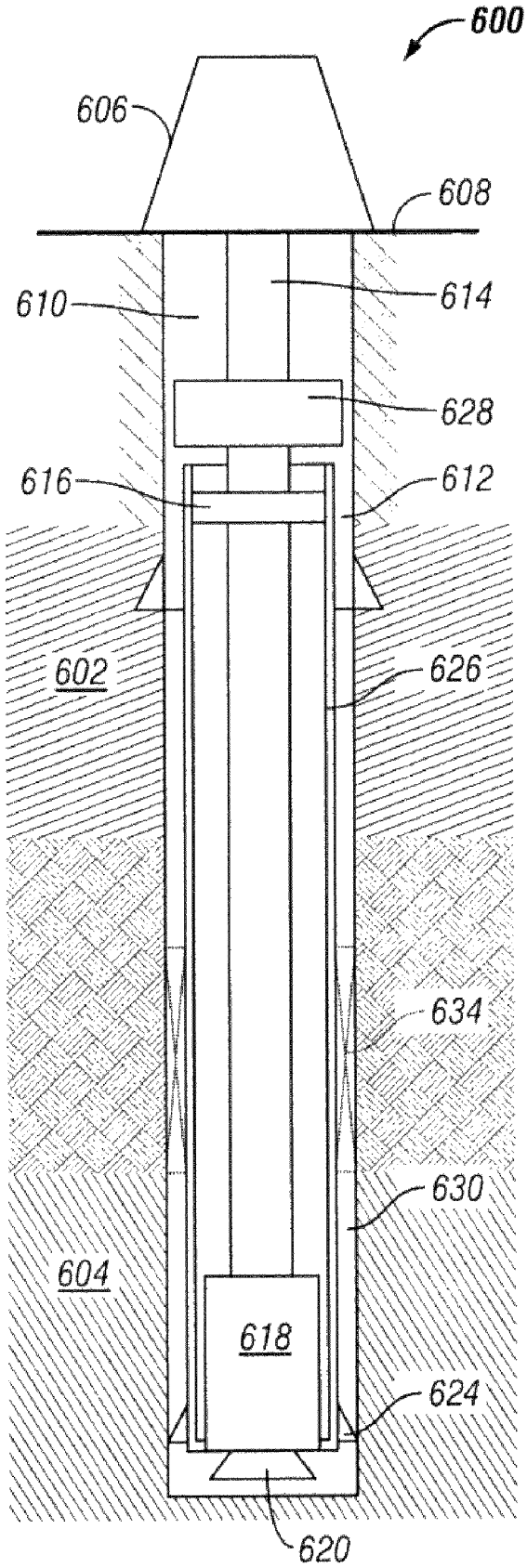
FIG. 6 schematically illustrates a liner drilling system utilizing an APD Device made in accordance with one embodiment of the present invention.

Referring now to FIG. 6, there is shown an embodiment of a drilling system 600 adapted to drill a wellbore that intersects two or more formations that have different values for a selected formation parameter. That is, for example, a situation wherein a formation 602 having a high pore pressure, or "high-pressure formation" overlies a depleted formation 604 having a lower pore and fracture pressure, or "low-pressure formation".

The drilling system 600 includes a rig 606 at the surface 608 of the earth in which a borehole 610 is drilled. A casing 612 has been set in the upper portion of the borehole 610. A drilling tubular 614 passes through the casing 612 to a liner hanger/packer 616 at the bottom of the cased portion of the hole and carries a drilling liner-bottom hole assembly (DL-BHA) 618 at its lower end. The DL-BHA 618 has, at its bottom end, a pilot bit 620 and an underreamer or core bit 624. A liner 626 hangs from the liner hanger 616 at its top end and is connected to the DL-BHA 618 at its bottom end. The liner is a tubular The pilot bit 620 drills a small diameter hole and the underreamer 624 enlarges the pilot hole to a size greater than the outer dimensions of the liner 626. The drilling assembly is retrievably attached to the liner bottom and can be retrieved without retrieving the liner 616. The drilling tubular 614 may be a drill pipe or coiled tubing. Exemplary liner drilling systems are discussed in U.S. Pat. Nos. 6,419,033, 6,196,336, and 5,845,722, all of which are commonly assigned, and are ally hereby incorporate by reference for all purposes. The term liner is generally understood to be a tubular member that is suitable to be connected to the wellbore with cement, gel or other material or device and that does not extend up to the surface.

To control wellbore pressure, an active pressure differential device 628 is positioned uphole of the liner hanger 616. The APD Device 628 can be of any configuration previously discussed with respect to FIGS. 1-5.

During drilling, drilling fluid is pumped into the drilling tubular 614. The drilling fluid exits out of the drill bit 620 and flows uphole between an annulus 630 formed by the liner and the wellbore and then between an annulus formed by the drilling tubular and the casing. The APD Device 628 is positioned in the casing such that the drilling fluid flowing uphole in the casing crosses the APD Device 628. Thus, operation of the APD Device 628 reduces pressure in the fluid column in the annular areas below the APD Device 628 in a manner previously described with reference to FIGS. 1-5.

In one exemplary operation, the mud weight of the drilling fluid circulated in the wellbore 610 is selected to provide a hydrostatic pressure that is at least equal to the pore pressure of the formation 602. Thus, even when drilling fluid is not circulating, the drilling fluid column in the wellbore 610 applies a pressure to the formation 602 that prevents formation fluids from entering the wellbore 610 (i.e., creates an at balance or over-balanced condition). This applied pressure, however, is likely higher than the fracture pressure of the lower pressure formation 604. Thus, a wellbore section intersecting the lower pressure formation 604 suffers a certain level degree or amount of deterioration. Upon the start of drilling, the dynamic pressure losses associated with the circulating fluid normally increase the pressure applied to the formation 604, which further increases the rate of hole deterioration and loss of fluid into the formation 604. Advantageously, the pressure differential created by the APD Device 628 can be selected to minimize or eliminate the dynamic pressure losses. Because the low-pressure formation is subjected to a lower circulating pressure due to the APD Device 628, the low-pressure formation undergoes a relatively slower rate of deterioration and slower loss of drilling fluid into the formation 604. Thus, the onset of a well collapse is delayed. Accordingly, the DL-BHA 618 can drill and advance further into the lower-pressure formation 604 before drilling is interrupted by well collapse.

In other embodiments, the system 600 can include an open hole APD Device 634 that is positioned in the open hole wellbore between the upper and lower formations 602 and 604. Such an APD device can, for example, be anchored in the open hole using suitable packer and energized by electric power. In still other embodiments, two or more APD Devices can be strategically positioned along the wellbore to provide active pressure management for two or more formations. Also, the APD Device does not necessarily have to be positioned uphole of the liner hanger. As long as the APD Device is in fluid communication with the fluid in the annulus, the APD Device can control pressure in the wellbore. Thus, in certain embodiments, The APD Device could be positioned in the liner itself and flow diverted from the annulus into the APD Device.

It should be appreciated that embodiments of the present invention can also be utilized to manage wellbore pressure where a low-pressure formation overlies a high-pressure formation. It should also be appreciated that the pressure management techniques discussed above can also be utilized if a wellbore has intersected or is expected to intersect two or more formations have different values for parameter that are influenced by pressure.

Further, it should be appreciated that the teachings of the present invention can be advantageously applied to manage wellbore pressure throughout the well construction process. As is known, formations can have a narrow "window" within which wellbore pressure must be maintained to prevent a kick or damage to the formation. As discussed previously, the lower pressure limit is generally the pore pressure of the formation and the upper limit is the fracture pressure of the formation. Formations having such narrow "window" may require pressure management in the completion phase as well as the drilling phase. That is, if a narrow pressure window was a consideration during drilling, it will also likely be a consideration when deploying equipment in the wellbore. Exemplary deployments include running equipment such as a liner in the wellbore, setting packers and operating hydraulically actuated tools.

Figure 7:
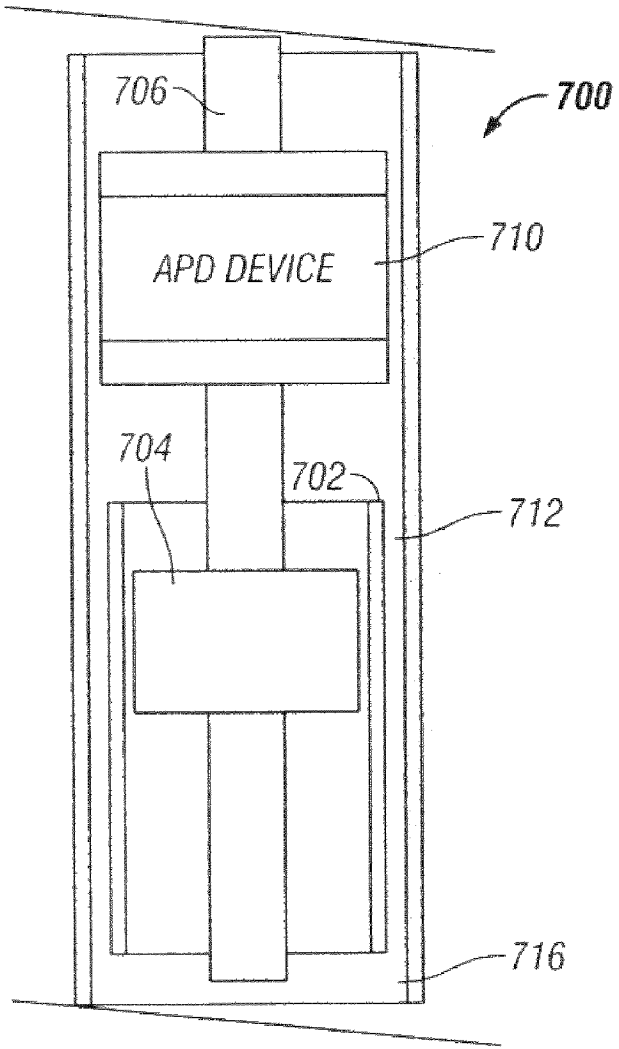
FIG. 7 schematic illustrates a wellbore equipment running device utilizing an APD Device made in accordance with embodiments of the present invention.

For instance, in certain situations, drilling fluid may be circulated during completion operations wherein wellbore tools are deployed in the wellbore. An exemplary operation is the running of a liner into the wellbore. Referring now to FIG. 7, there is shown a system 700 for controlling wellbore pressure when running a liner, or other wellbore equipment such as a packer, screen, whipstock, fishing tool, measurement tool, etc., in the wellbore. The running system 700 includes wellbore equipment such as a liner 702, a running tool such as a liner hanger 704, and a work string 706. Positioned adjacent the liner hanger 704 is an APD Device 710. In one embodiment, the APD Device 710 is energized using pressurized drilling fluid. Thus, once drilling fluid circulation commences, the APD Device 710 creates a pressure differential in the fluid in an annulus 712 between the liner 702 and the casing or wellbore wall. This pressure differential can reduce or eliminate the dynamic pressure losses and allow the liner to be run in the wellbore while staying within the pressure window of the formation. In like manner, the APD Device 710 can be used when setting packers and hydraulically actuating tools.

Moreover, when wellbore equipment such as a liner are conveyed or "run" into the wellbore, the downhole movement of the equipment causes a pressure increase in the resident wellbore fluid. Known as "surge effect," this pressure increase or spike can well exceed the formation fracture pressure. In certain embodiments of the present invention, the APD Device can be configured to cause a pressure differential that mitigates the surge effect during running of wellbore tools.

In yet other applications, a fluid may be circulated in the wellbore may be used to energize or actuate a device such as a packer, a perforating gun or other device adapted to perform a selected wellbore function. Also, wellbore pressure sometimes is increased to actuate such tools. An APD Device suitable positioned in the wellbore can be used to control wellbore pressure during such operations.

As discussed previously, drilling fluid or "mud" is used throughout the drilling process and sometimes utilized during completion and workover activity. Often, however, a fluid other than drilling fluid is used during completion and workover. In these applications, the APD Device can be used to manage wellbore pressure even when a non-drilling fluid is circulated in the wellbore.

Figure 8:
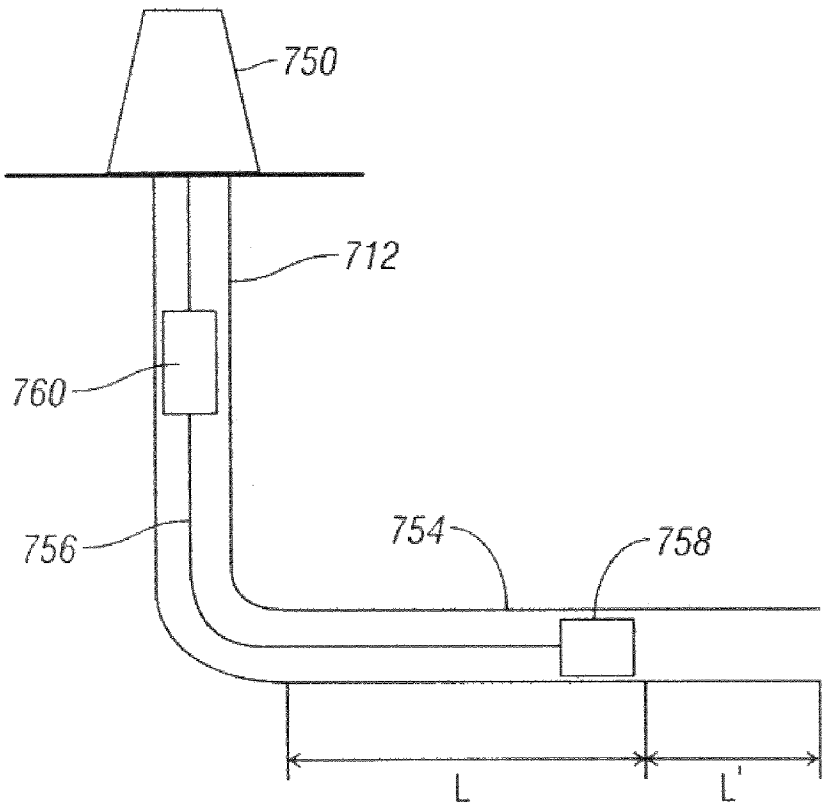
FIG. 8 schematic illustrates an APD Device utilized to control wellbore pressure in a non-drilling context in accordance with embodiments of the present invention.

In one such application, the APD Device can be used to manage pressure variations that may occur during completion activity such as setting gravel packs. Gravel packing of a well borehole involves placing sized gravel or sand within a wellbore external to a screen. The gravel pack sand and screen slots are sized to prevent formation sand migration into the wellbore. Referring now to FIG. 8, there is schematically illustrated a rig 750, which can be on shore or offshore, over a wellbore 752 having an extended lateral section 754 that requires a completion activity such as gravel packing. One method of setting gravel packs is to pump a fluid containing gravel particles via a work string 756 into the wellbore 752. The work string 752 can include a tubular such as drill string, coiled tubing, production tubing, etc. Using suitable flow control devices, the fluid is directed to the annular space external to a screen 758. While flowing through the screen 758 and into the bore of the work string 752, the gravel particles are strained and deposited in the external annular space to form a gravel pack. The gravel pack filters out sand and other material from the produced fluid and also strengthens the wellbore.

The fluid or slurry entrained with gravel particles when pumped downhole also suffers dynamic pressure losses. As is known, dynamic pressure losses vary directly with the length L of the wellbore. Thus, it should be appreciated that as the length L of the wellbore increases, the total pressure applied to the formation, e.g., hydrostatic plus dynamic pressure losses, also increases. Conventionally, in certain formations, the length of the wellbore is limited to ensure that this total applied pressure does not exceed the fracture pressure of the formation. Advantageously, an APD Device 760 can be positioned in the wellbore to reduce or eliminate the dynamic pressure losses when pumping the fluid conveying the gravel particles. By eliminating the dynamic pressure losses, the APD Device 760 keeps the total pressure applied to the formation below the fracture pressure for a longer period. Therefore, the length L of the wellbore can be increased by an amount shown by the length L'. This can be advantageous, because extending the reach of the lateral wellbore can expose more of the hydrocarbon bearing formation to the wellbore and enhance the production of hydrocarbons from the intersected formation.

It should be understood that fluids conveying gravel and sand particles are merely representative of non-drilling fluids used in the wellbore. Generally speaking, drilling fluids are fluids used to flow drill cuttings to the surface, cool and lubricate the drill bit during drilling and/or provide a desired amount of pressure in the wellbore. Non-drilling fluids are typically introduced into the wellbore after drilling and include, but are not limited to, completion fluids and workover fluids. Completion fluids are generally a solids-free liquid used to control a well should downhole hardware fail and to help place certain completion-related equipment, such as gravel packs, without damaging the producing formation. Completion fluids include brines and other fluids having suitable density and flow characteristics. Workover fluids are fluids used during workover operations. Since the wellbore is in contact with the reservoir during most workover operations, workover fluids are generally chemically compatible with the reservoir fluids and formation. Still other non-drilling fluids include cement slurries and acids.

Thus, in one aspect, embodiments of the present invention can be used to manage or control wellbore pressure outside the drilling context. These embodiments can be utilized in wellbores where drilling fluid is being circulated or in instances wherein a fluid other than drilling fluid is being circulated in the wellbore.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A method for controlling pressure in a wellbore containing a fluid, comprising:

running a selected wellbore equipment positioned above a drill bit in the wellbore, the selected wellbore equipment causing a pressure increase in the well; and operating an active pressure differential device (APD Device) positioned in the wellbore without drilling the wellbore and during running of the selected wellbore equipment to control the pressure of the fluid in a wellbore annulus above the selected wellbore equipment, the APD device having a channel with an inlet receiving a fluid from the wellbore annulus and an outlet channeling the fluid into the wellbore annulus, wherein the APD Device is a pump and further comprising energizing the pump with a motor.

2. The method of claim 1 further comprising circulating fluid in the wellbore while running the selected wellbore equipment in the wellbore.

3. The method of claim 2 wherein the APD Device reduces a dynamic pressure loss associated with the circulating fluid.

4. The method of claim 1 wherein the selected wellbore equipment includes a liner; and further comprising: conveying the APD Device and the liner using a drill string.

5. The method of claim 4 further comprising positioning the APD Device above the liner.

6. The method of claim 1 wherein the selected wellbore equipment is one of: (i) a wellbore tubular, (ii) a liner, (iii) a screen and (iv) a packer.

7. The method of claim 1 wherein the APD Device reduces a surge effect associated with the running of the selected wellbore equipment.

8. The method of claim 1, further supplying a pressurized fluid into the wellbore via a supply path, and forming a path across the APD Device for receiving the fluid from the wellbore annulus, the path being substantially sealed from the supply path.

9. A method for controlling pressure in a wellbore drilled in a formation, comprising:

circulating a non-drilling fluid in the wellbore;

positioning an Active Pressure Differential Device (APD Device) at a stationary location in the wellbore to receive a fluid from a wellbore annulus and to channel the fluid into the wellbore annulus;

controlling pressure in a wellbore annulus by operating the APD Device, wherein controlling wellbore pressure includes maintaining wellbore pressure below a fracture pressure of the formation.

10. The method of claim 9 wherein the non-drilling fluid is one of (i) a completion fluid, and (ii) a workover fluid.

11. The method of claim 10 wherein the APD Device reduces a dynamic pressure loss associated with the circulating non-drilling fluid.

12. The method of claim 10 wherein the non-drilling fluid includes a fluid having gravel particles.

13. A method for drilling a wellbore in a formation, comprising:

providing a drill string formed at least partially of a tubular member that does not extend to the surface and is adapted to be connected to the wellbore;

positioning an active pressure differential device (APD Device) above the tubular member and in the wellbore;

conveying the drill string into the wellbore; and controlling pressure in a wellbore annulus using the APD Device to receive a fluid from a wellbore annulus and to channel the fluid into the wellbore annulus.

14. The method of claim 13 further comprising circulating drilling fluid in the wellbore and reducing a dynamic pressure loss associated with the circulating drilling fluid using the APD Device.

15. The method of claim 13 wherein the wellbore intersects a first formation and a second formation, each having a different value for a formation parameter.

16. The method of claim 15 wherein the formation parameter is selected from one of: (i) a pore pressure and (ii) a fracture pressure.

17. The method of claim 13 further comprising circulating a drilling fluid in the wellbore having a weight selected to provide a wellbore pressure greater than a pore pressure of one of the first formation and the second formation.

18. The method of claim 13 further comprising positioning the APD Device in a cased section of the wellbore.

19. The method of claim 13 wherein the tubular member is a liner adapted to be cemented in the wellbore.

* * * * *